US010092123B2

(12) United States Patent
Drew

(10) Patent No.: US 10,092,123 B2
(45) Date of Patent: Oct. 9, 2018

(54) APPARATUS FOR VISUAL REMINDER OF SURRENDERED BURDENS TO GOD

(71) Applicant: RAD JOY, LLC, Grapevine, TX (US)

(72) Inventor: Richard Alan Drew, Grapevine, TX (US)

(73) Assignee: Rad Joy, LLC, Grapevine, TX (US)

( * ) Notice: Subject to any disclaimer, the term of this patent is extended or adjusted under 35 U.S.C. 154(b) by 227 days.

(21) Appl. No.: 15/139,258

(22) Filed: Apr. 26, 2016

(65) Prior Publication Data

US 2017/0303721 A1 Oct. 26, 2017

(51) Int. Cl.
*G09B 19/00* (2006.01)
*A47G 33/00* (2006.01)

(52) U.S. Cl.
CPC ..... *A47G 33/00* (2013.01)

(58) Field of Classification Search
USPC ..... 434/245, 408, 428, 429, 430, 433; 40/618, 620, 622, 624; D11/95, 96, 131, D11/157; D99/27
See application file for complete search history.

(56) References Cited

U.S. PATENT DOCUMENTS 2,025,833 A * 12/1935 Sorensen ..... B43L 1/06 434/417
2,520,661 A * 8/1950 Stanley ..... A47G 33/02 206/19
2,650,445 A * 9/1953 Randall ..... A44C 25/005 428/3
4,133,123 A * 1/1979 Anderson ..... G09F 7/02 40/1
4,296,866 A * 10/1981 Learnard ..... A47F 5/02 211/131.1
4,358,013 A * 11/1982 Shebley ..... A47G 33/00 206/232
4,493,652 A * 1/1985 Mike ..... G09B 5/06 40/436
D333,614 S * 3/1993 Miguel ..... D19/75
5,456,625 A * 10/1995 Dumond ..... A63H 3/006 362/121
D652,764 S * 1/2012 Cadigan ..... D11/157
D656,429 S * 3/2012 Cadigan ..... D11/96
2005/0164150 A1* 7/2005 Woods ..... G09B 19/00 434/245
2007/0224581 A1* 9/2007 Cybulski, Jr. ..... G09B 1/00 434/245

* cited by examiner

*Primary Examiner* — Kurt Fernstrom

(74) *Attorney, Agent, or Firm* — Wei Wei Jeang; Grable Martin Fulton PLLC

(57) ABSTRACT

Apparatus for a visual reminder of surrendered burdens to God includes a wooden cross having first and second sides, where the wooden cross is configured to be viewable with at least one side visible. The apparatus further includes a plurality of paper notes configured to be inscribed upon by a user and be fastened to the at least one visible side of the wooden cross by a plurality of wrought iron nails.

18 Claims, 2 Drawing Sheets

APPARATUS FOR VISUAL REMINDER OF SURRENDERED BURDENS TO GOD

FIELD

The present disclosure relates to the field of message boards, and in particular a visual reminder of surrendered burdens to God and for performing religious rituals and meditative practices.

BACKGROUND

Followers of Christ are counseled to "take up your cross and follow me" (Matthew 16:24; Mark 8:34; Luke 9:23) and to surrender their burdens and worries to Christ. Christ said, "Come to me, all you who are weary and burdened, and I will give you rest." Matthew 11:30, This teaching is echoed in Philippians 4:6-7, "Do not be anxious about anything, but in everything, by prayer and petition with thanksgiving, present your requests to God. And the peace of God, which transcends all understanding, will guard your hearts and your minds in Christ Jesus."

DETAILED DESCRIPTION

Figure 1:
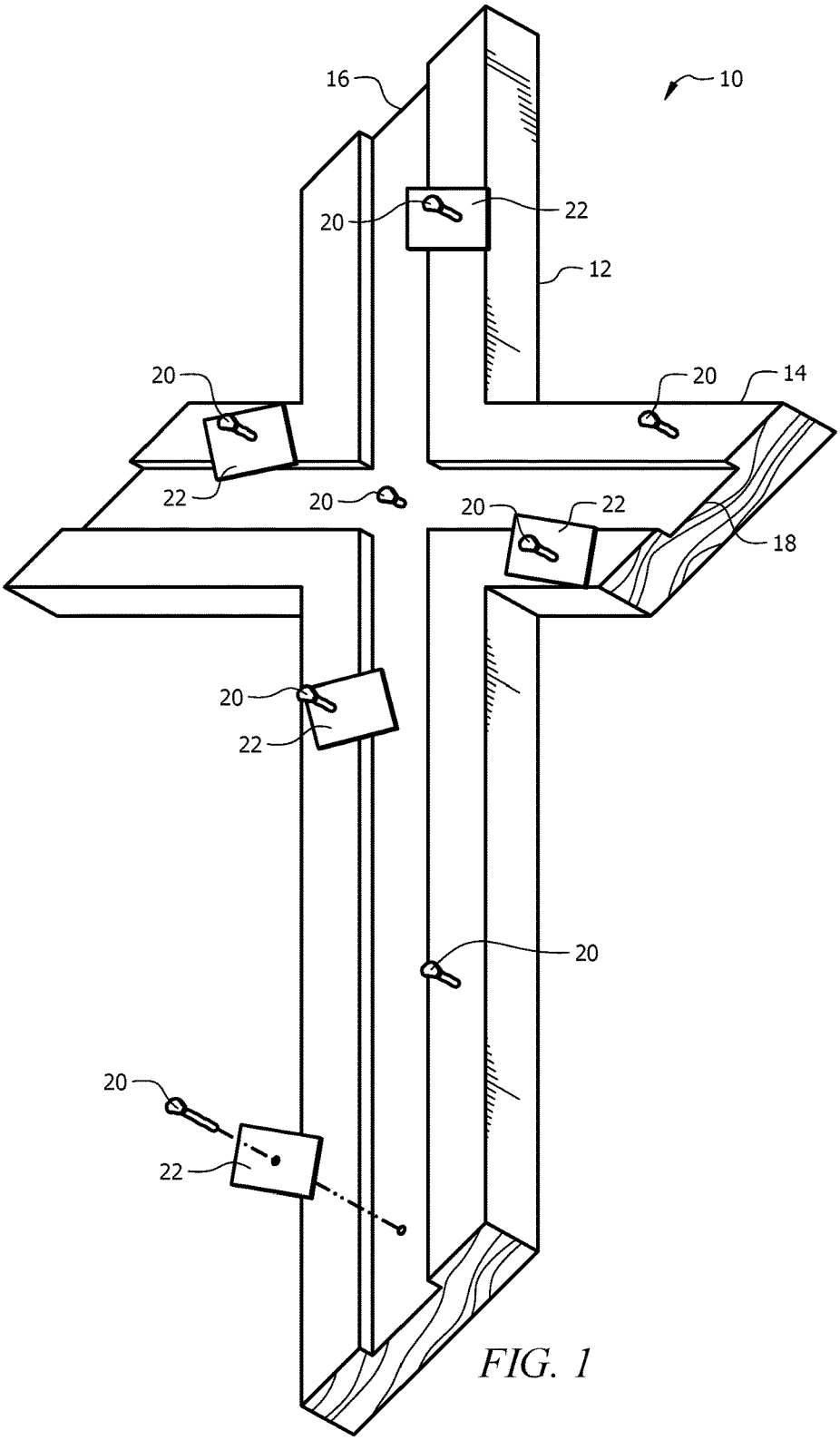
FIG. 1 is a perspective view of an exemplary embodiment for an apparatus for a visual reminder of surrendered burdens to God in the form of a stylized wooden cross.
Figure 2:
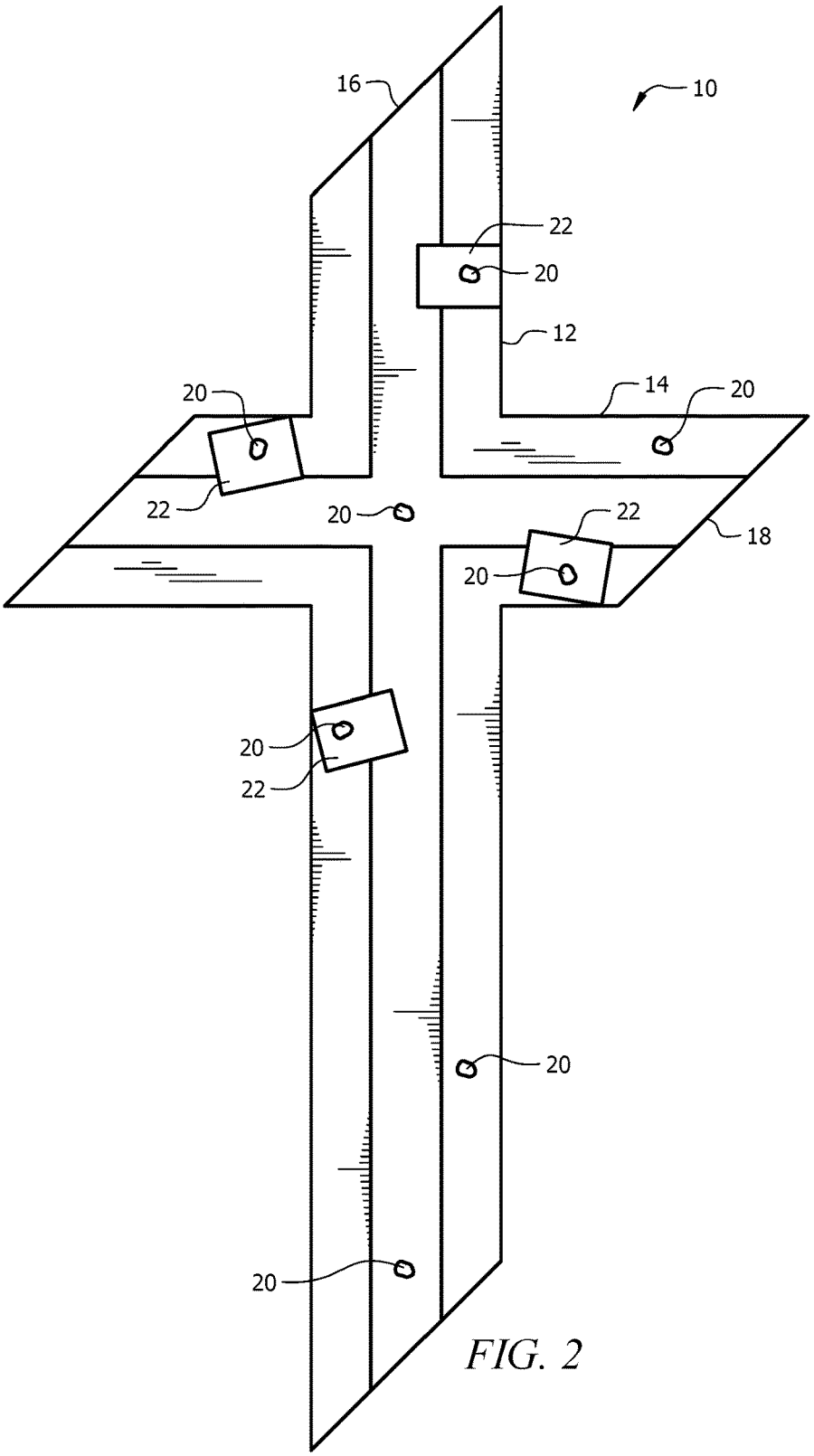
FIG. 2 is a front view of an exemplary embodiment for an apparatus for a visual reminder of surrendered burdens to God in the form of a stylized wooden cross.

FIGS. 1 and 2 provide perspective and front views of an exemplary embodiment of an apparatus for a visual reminder of surrendered burdens to God 10 in the form of a stylized wooden cross. Followers of Christ are repeatedly advised in the Bible to surrender their burdens and worries to God, such as counseled by Paul to the citizens of Philippi, "Do not be anxious about anything, but in everything, by prayer and petition with thanksgiving, present your requests to God." Philippians 4:6, The apparatus for a visual reminder of surrendered burdens to God 10 is preferably shaped in the form of a cross, to further remind the user of Christ's ultimate sacrifice. The cross is preferably constructed of first and second linear members 12 and 14 that are fastened to form the shape of a cross. The first linear member 12 forms the vertical post of the cross, and the second linear member 14 forms the horizontal beam of the cross, where the first linear member 12 is preferably longer than the second linear member 14. The first and second linear members 12 and 14 are preferably constructed of solid wood, but other materials including cork, plastic, metal, ceramic, etc. may be substituted. As shown, the front faces of the first and second linear members 12 and 14 include a channel 16 and 18 for decorative purposes. Alternatively, for a wooden cross mounted on a base for display on a mantel or table top, both sides of the cross may be similarly shaped and decorated. Other forms of embellishments may be added to the cross.

A plurality of fasteners 20, preferably in the form of one or more iron nails (e.g., decorative steel wrought-head nails, rough wrought iron nails, antique nails, pegs, etc.) are pre-fastened into pre-formed holes made on at least one face of the cross at various locations. The nails are friction fit into the pre-formed holes and can be easily removed by the user.

The size and number of the nails fastened to the cross is dependent on the size of the cross and the desired esthetic effect.

The cross may be fastened to a highly visible spot on a wall, or fastened to a vertical post with a base that can be positioned on a table or mantle, for example. The user may write down or inscribe their worries and concerns on pieces of paper 22 (e.g., parchment paper, note paper, flash paper, and the like) and symbolically "nail" the paper notes 22 to one or both sides of the cross. The user may incorporate a ceremony of surrendering all worries, sins, and burdens to God using the apparatus of the present disclosure into a family tradition that is practiced at holidays and family gatherings.

There are many alternative ways that the device of the present disclosure can be implemented. For example, the embodiment may be of any size and or maintain a varied quantity of pre-formed holes. Alternatively, or in addition to the blank paper notes, a plurality of pre-inscribed "notes" (on paper, metal, leather, or other materials) may be provided for selection by the user to nail or otherwise fasten to the cross. Further, symbolic objects or charms that represent common worries, such as a charm in the shape of a dollar sign, house, car, family, etc. may be provided to enable a user to hang or fasten these objects onto the cross using the nails. Although iron nails are preferred because they symbolize Christ's suffering, other types of fasteners may be used.

The cross is an interactive system/method/apparatus for enhancing prayer, providing tangible evidence of prayers offered, and serving as a visual reminder. The cross serves as a useful daily visual reminder of worries and concerns that have been surrendered to God. The user may experience joy and release each time he/she sees the cross and be reminded of Christ's love. The daily visual reminder may also serve to remind him/her Christ's sacrifice and reinforce the user's commitment to Christ.

It should be noted that the visual reminder of surrendered burdens to God of the present disclosure encompasses embodiments that are based on shapes of other religious symbols of the Christian religion as well as other religions, including the Star of David, for example.

The features of the present invention which are believed to be novel are set forth below with particularity in the appended claims. However, modifications, variations, and changes to the exemplary embodiments described above will be apparent to those skilled in the art, and the apparatus for a visual reminder of surrendered burdens to God described herein thus encompasses such modifications, variations, and changes and are not limited to the specific embodiments described herein.

What is claimed is:

1. Apparatus for a visual reminder of surrendered burdens to God, comprising:

a wooden cross having first and second sides, the wooden cross being configured to be viewable with at least one side visible; and a plurality of paper notes configured to be inscribed upon by a user and be fastened to the at least one visible side of the wooden cross by a plurality of nails, wherein the wooden cross comprises a plurality of pre-formed holes for receiving the plurality of nails.

2. The apparatus of claim 1, wherein the wooden cross is configured to be fastened to a vertical surface with the first side facing away from the vertical surface.

3. The apparatus of claim 1, wherein the wooden cross is configured to be mounted to a base to be viewable with both first and second sides visible.

4. The apparatus of claim 1, further comprising a plurality of paper notes pre-inscribed with worries and concerns.

5. The apparatus of claim 1, wherein the pre-formed holes on the wooden cross is configured to receive the plurality of metal nails inserted by a user to secure the plurality of similarly-sized symbolic objects.

6. The apparatus of claim 1, further comprising a plurality of symbolic objects representing common worries and concerns made of a material selected from the group consisting of paper, metal, and leather and configured to be fastened to the at least one visible side of the wooden cross by the plurality of nails.

7. Apparatus for a visual reminder of surrendered burdens to God, comprising:

a religious symbol having first and second sides, the religious symbol being configured to be viewable with at least one side visible; and a plurality of pre-inscribed notes configured to be fastened to at least one visible side of the wooden religious symbol by a plurality of fasteners, wherein the religious symbol defining a plurality of pre-formed holes for receiving the plurality of fasteners.

8. The apparatus of claim 7, wherein the wooden religious symbol is in the shape of a cross.

9. The apparatus of claim 7, wherein the wooden religious symbol is configured to be fastened to a vertical surface with the first side facing away from the vertical surface.

10. The apparatus of claim 7, wherein the wooden religious symbol is configured to be mounted to a base to be viewable with both first and second sides visible.

11. The apparatus of claim 7, further comprising a plurality of paper notes pre-inscribed with worries and concerns.

12. The apparatus of claim 7, further comprising a plurality of symbolic objects representing common worries and concerns made of a material selected from the group consisting of paper, metal, and leather and configured to be fastened to the at least one visible side of the wooden cross by the plurality of fasteners.

13. Apparatus for a visual reminder of surrendered burdens to God, comprising:

a wooden cross having first and second sides, the wooden cross being configured to be viewable with at least one side visible, the wooden cross further comprising a plurality of pre-formed holes on the at least one visible side;

a plurality of similarly-sized symbolic objects representing worries and concerns; and a plurality of metal nails configured to be inserted into the pre-formed holes on the at least one visible side of the wooden cross to secure the plurality of similarly-sized symbolic objects to the wooden cross.

14. The apparatus of claim 13, wherein the plurality of similarly-sized symbolic objects comprise paper notes configured to be inscribed upon by a user and be fastened to the at least one visible side of the wooden cross by the plurality of metal nails.

15. The apparatus of claim 13, wherein the plurality of similarly-sized symbolic objects comprise paper notes pre-inscribed with worries and concerns to be fastened to the at least one visible side of the wooden cross by the plurality of metal nails.

16. The apparatus of claim 13, wherein the plurality of similarly-sized symbolic objects comprise a plurality of similarly-sized objects made of at least one material selected from the group consisting of paper, metal, and leather to be fastened by a user to the at least one visible side of the wooden cross by the plurality of metal nails.

17. The apparatus of claim 13, further comprising a plurality of paper notes prescribed with common worries and concerns configured to be fastened to the at least one visible side of the wooden cross by the plurality of metal nails.

18. The apparatus of claim 13, further comprising a plurality of paper notes to be inscribed by a user describing worries and concerns configured to be fastened to the at least one visible side of the wooden cross by the plurality of metal nails.

* * * * *